US008267106B2

(12) United States Patent
Jordache et al.

(10) Patent No.: US 8,267,106 B2
(45) Date of Patent: Sep. 18, 2012

(54) RETRACTABLE MOTOR VEHICLE SHELTER

(76) Inventors: Ronald Jordache, Banner Elk, NC (US); Gereon Elmer Poquette, Boomer, NC (US)

( * ) Notice: Subject to any disclaimer, the term of this patent is extended or adjusted under 35 U.S.C. 154(b) by 194 days.

(21) Appl. No.: 12/658,526

(22) Filed: Feb. 10, 2010

(65) Prior Publication Data

US 2010/0200035 A1 Aug. 12, 2010

Related U.S. Application Data

(60) Provisional application No. 61/207,490, filed on Feb. 12, 2009.

(51) Int. Cl.
*E04H 15/48* (2006.01)

(52) U.S. Cl. ..... 135/129; 135/153; 135/906

(58) Field of Classification Search ..... 135/124, 135/128, 129, 143, 151, 153, 132, 133, 906
See application file for complete search history.

(56) References Cited

U.S. PATENT DOCUMENTS 4,305,415 A 12/1981 Galli
4,834,128 A 5/1989 Burgess
4,886,083 A * 12/1989 Gamache ..... 135/88.06
4,991,612 A 2/1991 Kiss et al.
5,044,132 A 9/1991 Harman
5,121,765 A * 6/1992 MacMorris, Jr. ..... 135/143
5,740,826 A * 4/1998 Nevin et al. ..... 135/88.06
5,746,237 A 5/1998 Arnic
6,151,839 A 11/2000 Millward
6,763,842 B2 7/2004 Blount
7,013,904 B2 3/2006 Kofler
7,051,481 B2 5/2006 Delavega et al.
7,475,700 B2 1/2009 Pollard
7,500,276 B2 3/2009 Koren
7,604,016 B2 * 10/2009 Songest ..... 135/132

* cited by examiner

*Primary Examiner* — David Dunn
*Assistant Examiner* — Danielle Jackson
(74) *Attorney, Agent, or Firm* — Robert W. Pitts

(57) ABSTRACT

A shelter for a motor vehicle or other movable object is moved from a fully retracted position to a fully deployed position by a combination of linear and pivotal movement. The shelter includes a frame assembly including parallel rails with pole holding subassemblies mounted on and movable along the rails. Arched poles with a collapsible canopy covering the poles are mounted on the pole holders, and linear movement of one pole holder on each rail will pull or push the poles into position because the poles are connected by the canopy. Poles on parallel rails will be moved simultaneously. Front and rear pole holders are pivoted to enclose both the front and rear of the shelter, and the entire assembly can be retracted to a generally horizontal storage position by movement of swing arms from a position aligned with the rails to a position in which the swing arms extend upright relative to the rails.

13 Claims, 17 Drawing Sheets

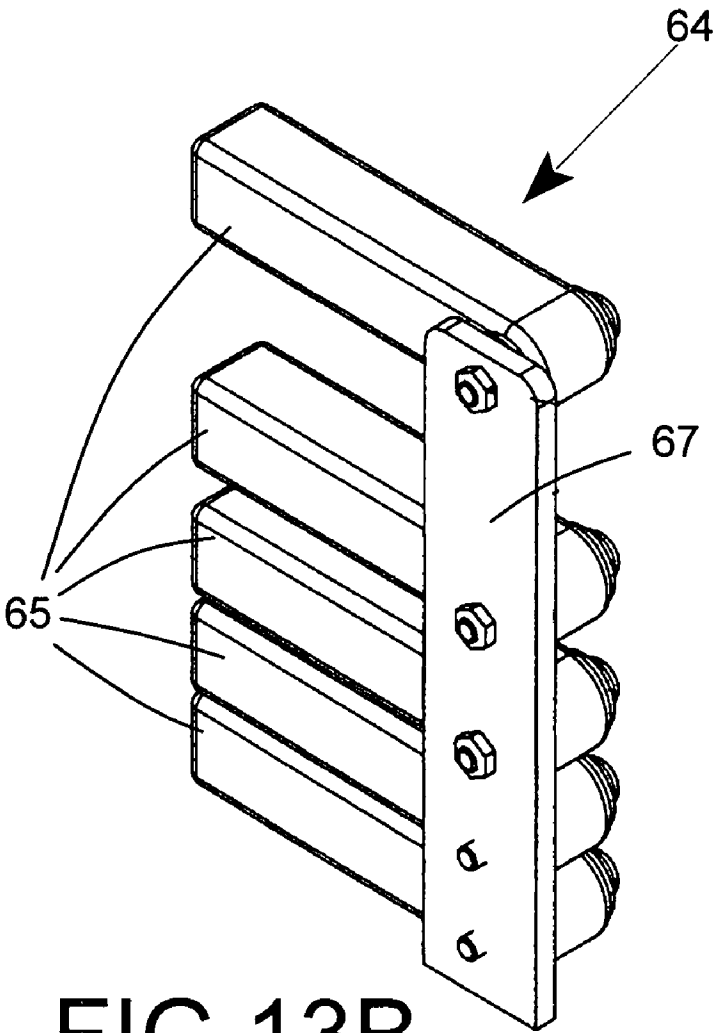
FIG 13B
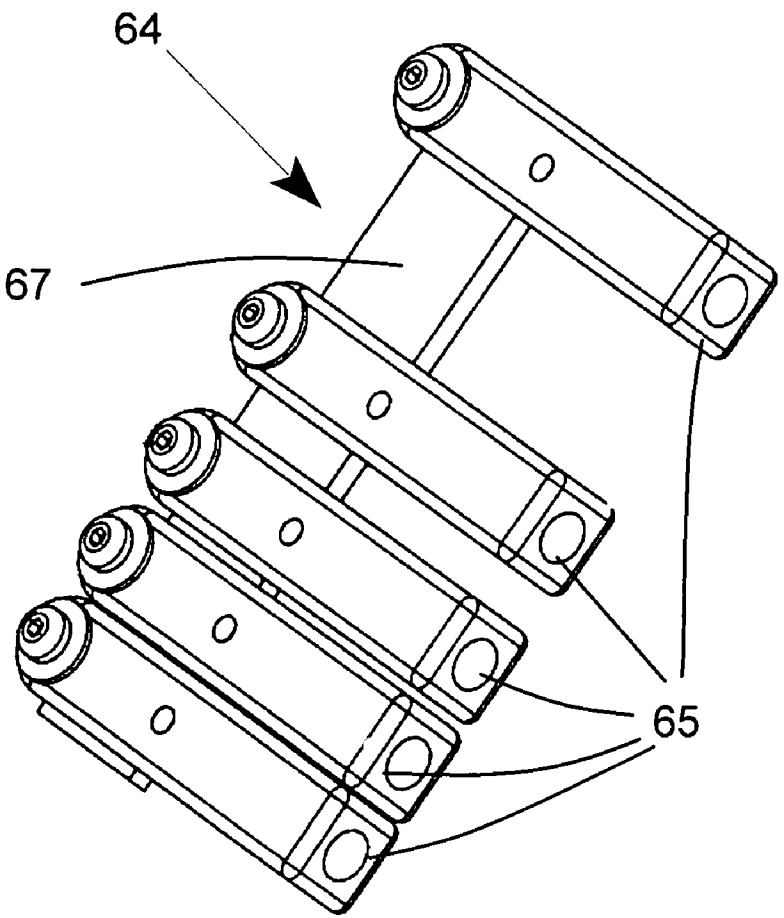
FIGB 13A

RETRACTABLE MOTOR VEHICLE SHELTER

CROSS REFERENCE TO PRIOR COPENDING APPLICATION

This application claims the benefit of prior Provisional Patent Application 61/207,490 filed Feb. 12, 2009, which is incorporated herein by reference.

BACKGROUND OF THE INVENTION

1. Field of the Invention

This invention is related to shelters or covers that can be positioned over a motor vehicle or other movable object. More particularly, this invention is related to temporary covers having a canopy that is supported by a metal frame, and can be deployed or retracted by movement of the frame members supporting the canopy.

2. Description of the Prior Art

There are basically two types of vehicle covers currently available on the market. The first is a cover that comes in contact with the vehicle as it is stretched over the surface and then is attached with elastic cords or ropes to the chassis. Installation of this cover is very time consuming and is usually favored for long term storage due to the labor involved in securing the cover. If the cover is removed frequently, it is prone to gathering dust and grit, which can be transferred to the car and damages the finish. Because these covers are wrapped directly around the surface of the vehicle, they can transfer moisture, dirt, salts and other corrosives directly to the vehicle's finish, with which they are in contact. When subject to outside elements, wind will cause shifting of the cover on the surface of a vehicle, which could cause abrasions or scratches. These traditional "rag and string" covers often require two people to install, and often they do not stay in place. The second cover is a pole construction and is usually coated with aluminum sheeting and mounted to the ground. Due to zoning restrictions in many areas, these covers are not allowed.

In addition to these devices that are in actual use, several devices that can be opened and closed to cover an automobile have been suggested. U.S. Pat. No. 5,746,237 is one such device, but it must be very large, compared to the car, because this portable garage is closed as the driver parks the car, and presumably space must be provided to allow the driver to exit the car and this portable garage.

U.S. Pat. No. 7,475,700 discloses a portable shelter in which each of the support members is pivotal approximately about the center section. This means that the arches must be relative high in the center, relative to the automobile in order for the arches to cover the front and rear of the care to be stored therein.

U.S. Pat. No. 7,051,481 and U.S. Pat. No. 6,763,842 disclose shelters that are intended to cover small articles, such as bicycles and motorcycles.

SUMMARY OF THE INVENTION

This invention provides a light-weight cover for the protection of automobiles, boats and the like from the environmental exposure to sun, precipitation, dust, and salt spray. It could also provide protection as a cover for swimming pools and gardens. This cover or shelter can also be employed as a temporary shelter for movable objects, such as objects that need to be stored at a construction site, but must be protected from the weather, but should be readily accessible as needed.

This invention provides a low priced unit, reasonably cost competitive with tie-down cloth covers in view of the additional features, that is non-contacting, collapsible, ground anchored and is easily operated, whether covering or uncovering, by one person in about 30 seconds. Since this shelter or cover can be stored in a low profile configuration, it will be less subject to damaging winds and it will not present an objectionable appearance when not in use.

This invention is especially suited for use in a salty coastal environment, which may also subject the vehicle to extreme heat and cold, to excessive humidity and to snow and storms.

Many of the shortcomings of existing covers are addressed with the shelter according to this invention. This cover does not, at any time, come in contact with the vehicle. The cover collapses into a small stack in front of the vehicle thereby eliminating the obnoxious appearance of the semi-permanent cover. Without walking around the vehicle, one person can easily cover their unit in about 30 seconds. Because of several different anchoring methods, depending on the ground surface, this cover is very stable under windy conditions but yet can be easily moved to other locations. In one version, this shelter or cover can be entirely or partially manually deployed or retracted into a retracted, collapsible configuration. This shelter can also be either partially or totally automated, as shown in the principle embodiment, so that small motors, that can be activated by remote control, can partially or fully deploy or retract the cover after the motor vehicle or other movable object has been properly positioned relative to the retracted cover. This shelter is faster and easier to assemble and breakdown than bulky tents or open carports. This shelter is superior to awkward tent covers and provides a sturdier, small footprint which can lie flat against the ground in the open, stored configuration. Shelters can be provided in multiple sizes to fit motorcycles, cars, pickups, leisure sporting boats and even larger vehicles and objects.

According to one aspect of this invention a retractable shelter incorporating these advantages can be shifted between a horizontal stored position and a deployed position. The shelter can include a pair of rails, with a movable elongate member, such as a continuous belt, reciprocating along each of the rails. A plurality of poles will slide along the rails in response to reciprocal movement of the elongate members, or belts, to which at least one pole along each rail is securable. Each pole extends between the rails and supporting a pliable canopy. The poles are rotatable at one end of the rails between the horizontal stored position and an upright configuration. These poles also move in the upright configuration, toward an opposite end of the rails to a deployed position.

This invention can also serve as a motor vehicle shelter movable from a stored position to a deployed position to shelter a motor vehicle. The shelter includes a canopy supported by arched, spaced poles when the shelter is in the deployed position. The canopy is collapsible as the poles are retracted to the stored position. Reciprocating pole holders move linearly with poles mounted thereon in an upright position between a front end and a rear end of the motor vehicle shelter. Front pole holders rotate from a horizontal toward more upright positions as the canopy is pulled by movement of the reciprocating pole holders to the deployed position to cover a motor vehicle in the deployed configuration. Rear pole holders can rotate from an upright configuration toward a horizontal position after the reciprocal pole holders have reached the rear end of the motor vehicle shelter to shelter the motor vehicle rear in the deployed position. Parallel tracks or rails on which the reciprocal pole holders move, extend between the front end and the rear end.

Alternatively this invention can comprise an erectable and collapsible shelter deployable over a movable object. This shelter can include a motor and a pair or rails. Each rail can include a movable elongate member, such as a belt. The movable elongate members are powered by the motor. A canopy is movable between opposite ends of the rails in response to motor driven operation of the movable elongate members. A plurality of movable arch members extend between the pair of rails to support the canopy. The movable arch members are connected to the movable elongate members, or belts, so that the arch members move along the track in response to movement of the movable elongate belts or similar members. The arch members can be disconnected from the movable elongate members for movement of the arch members to a storage position in which the canopy is collapsed.

BRIEF DESCRIPTION OF THE DRAWINGS

FIGS. 13A and 13B are three dimensional views showing opposite sides of the front pole holder subassembly which allows the canopy and arch poles at the front end to rotate upwardly into fully and partially upright positions.

DETAILED DESCRIPTION OF THE PREFERRED EMBODIMENTS

A motor vehicle or movable object, such as an automobile 2, can be stored in a shelter 10 comprising the preferred embodiment of this invention. The shelter 10 can be erected or raised after the vehicle 2 is moved into position and can be retracted or collapsed after the vehicle 2 is moved and the shelter is no longer needed. The preferred embodiment of the shelter 10 can be positioned in a driveway and can remain there in a collapsed configuration when not in use. In the collapsed or retracted configuration, the shelter will have a low profile and will not form a visible obstruction or be unsightly. Although the preferred embodiment of this invention is normally intended for use as an automobile shelter, it can be used for other purposes. For instance it can be erected on a dock and can serve as a shelter for a boat. Larger versions of this shelter could be used for trucks or for other vehicles. Even larger versions can also be used to cover items that need to be stored in an outdoor location, but need to be protected from rain, sun or other environmental factors. For example, one version of this shelter 10 could be employed on a construction site for supplies that would need to be covered overnight in the event of rain, but which would need to be accessible during work hours, when the shelter 10 could be completely retracted.

Figure 19:
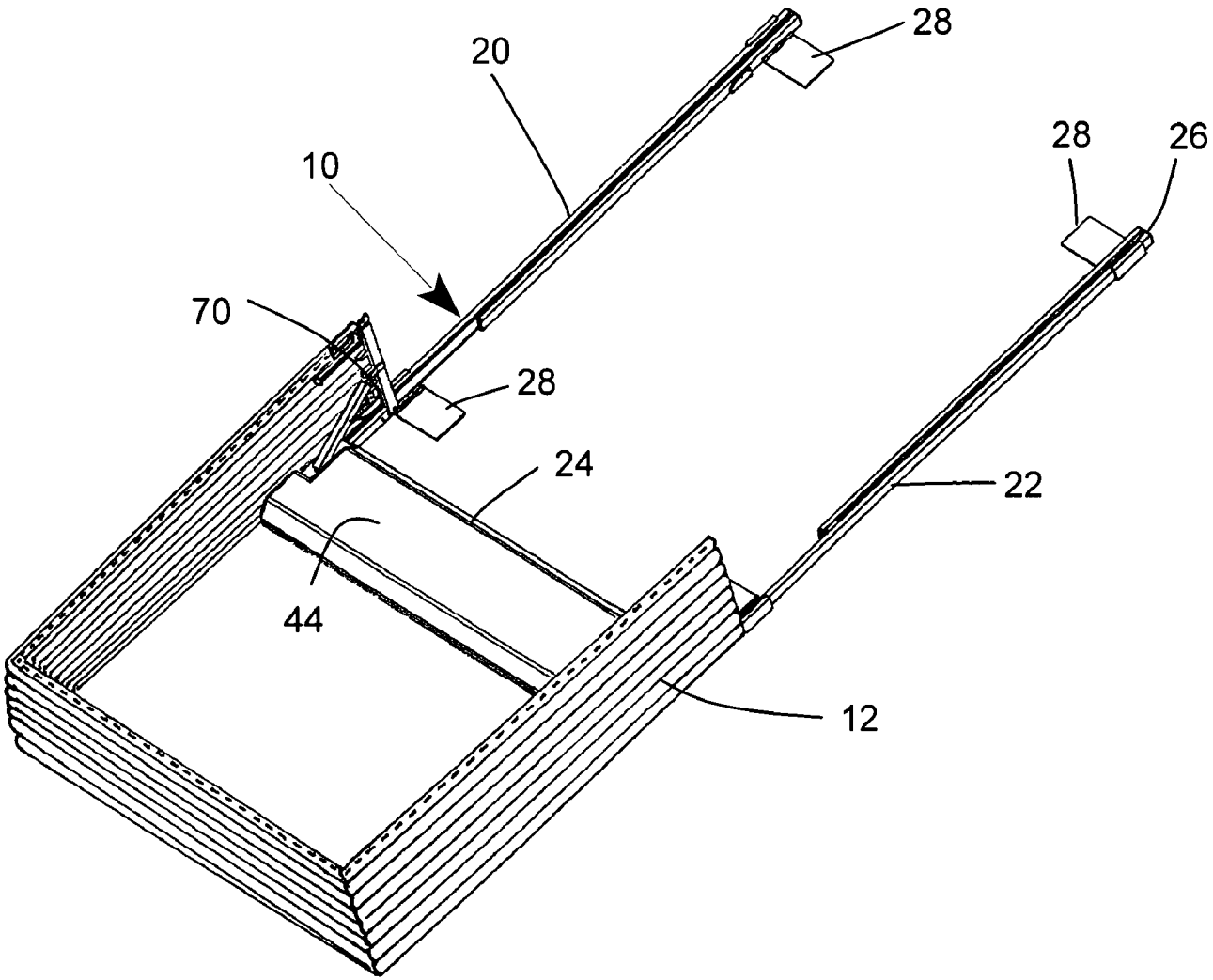
FIG. 19 is a view of the shelter, with the canopy mounted on arched poles in a retracted or collapsed configuration.
Figure 20:
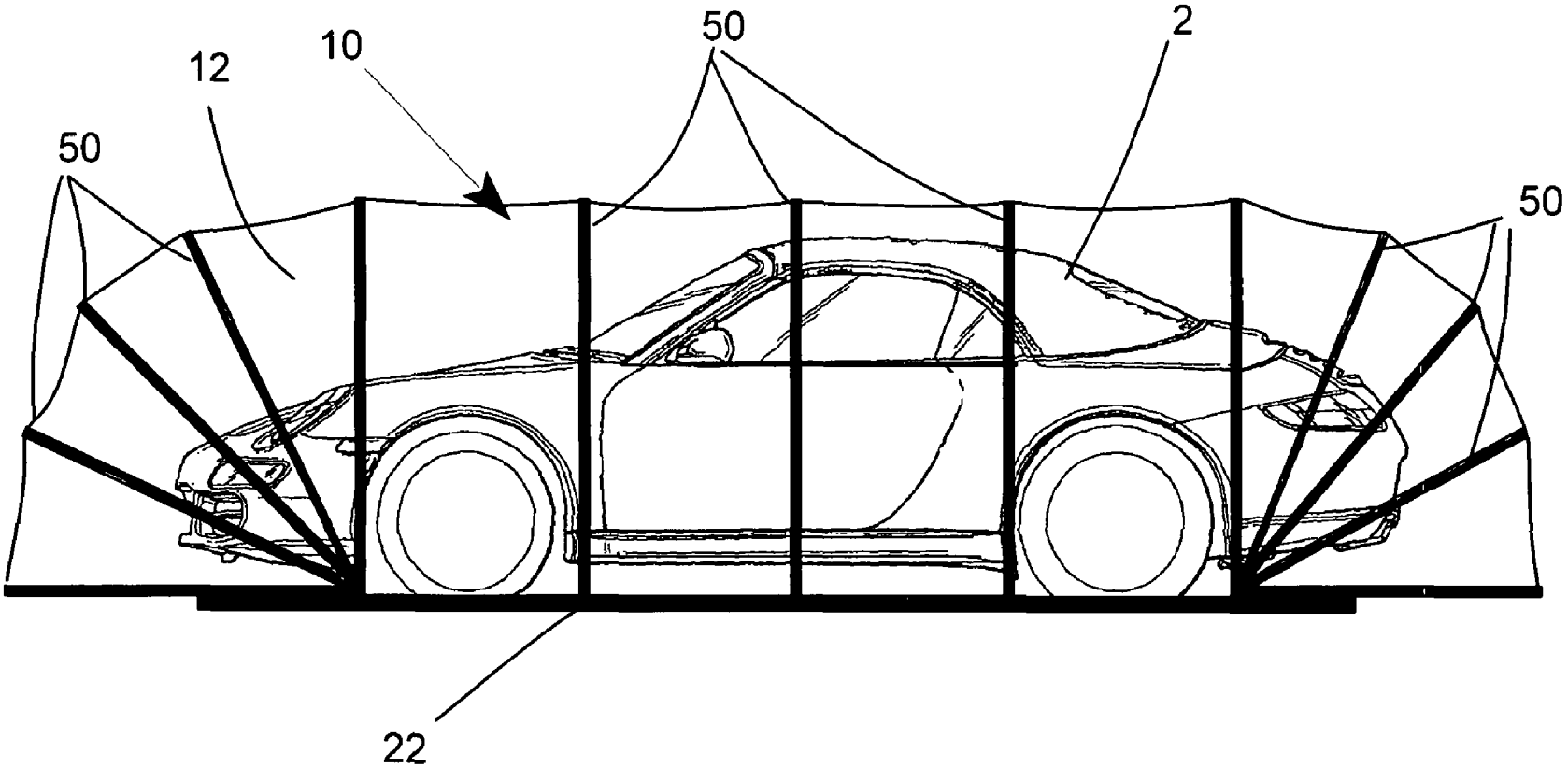
FIG. 20 is a side view of the shelter enclosing an automobile as it would in the deployed configuration.

The shelter 10 includes a pair of rails 20, 22, on which arched poles 50, will be supported and can move from a stored or collapsed configuration, shown in FIG. 19, to a deployed configuration, shown in FIG. 20, in which a canopy 12 mounted on the arched poles 50 can at least be positioned over the vehicle or object being protected. In the preferred embodiment the canopy can be completely closed in the deployed configuration with the canopy 12 enclosing not only the top, but also the front and rear of the shelter 10.

Figure 1:
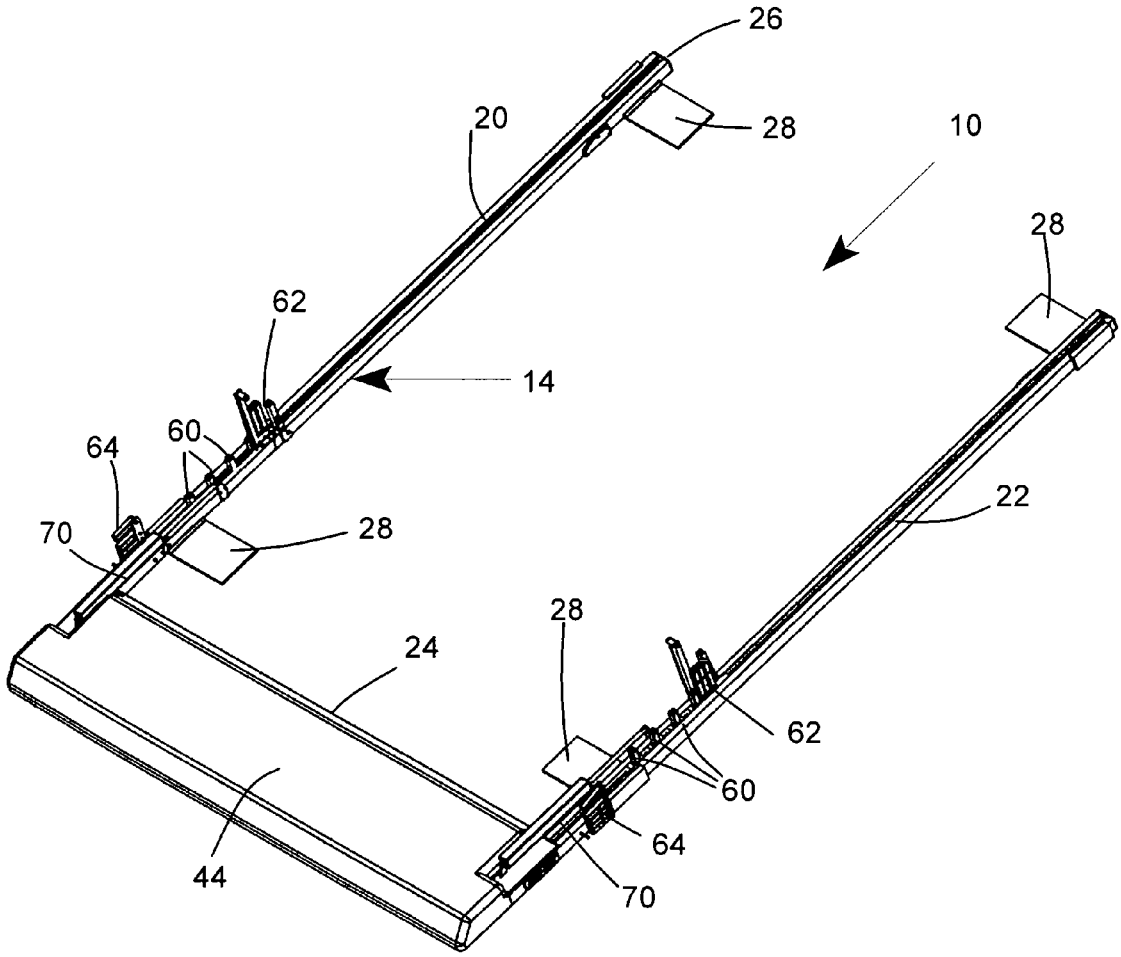
FIG. 1 is a three dimensional view of the components of a frame for the shelter of this invention, which in combination with a canopy forms the shelter. The canopy has been removed for FIGS. 1-5 to better illustrate the components of the frame.
Figure 2:
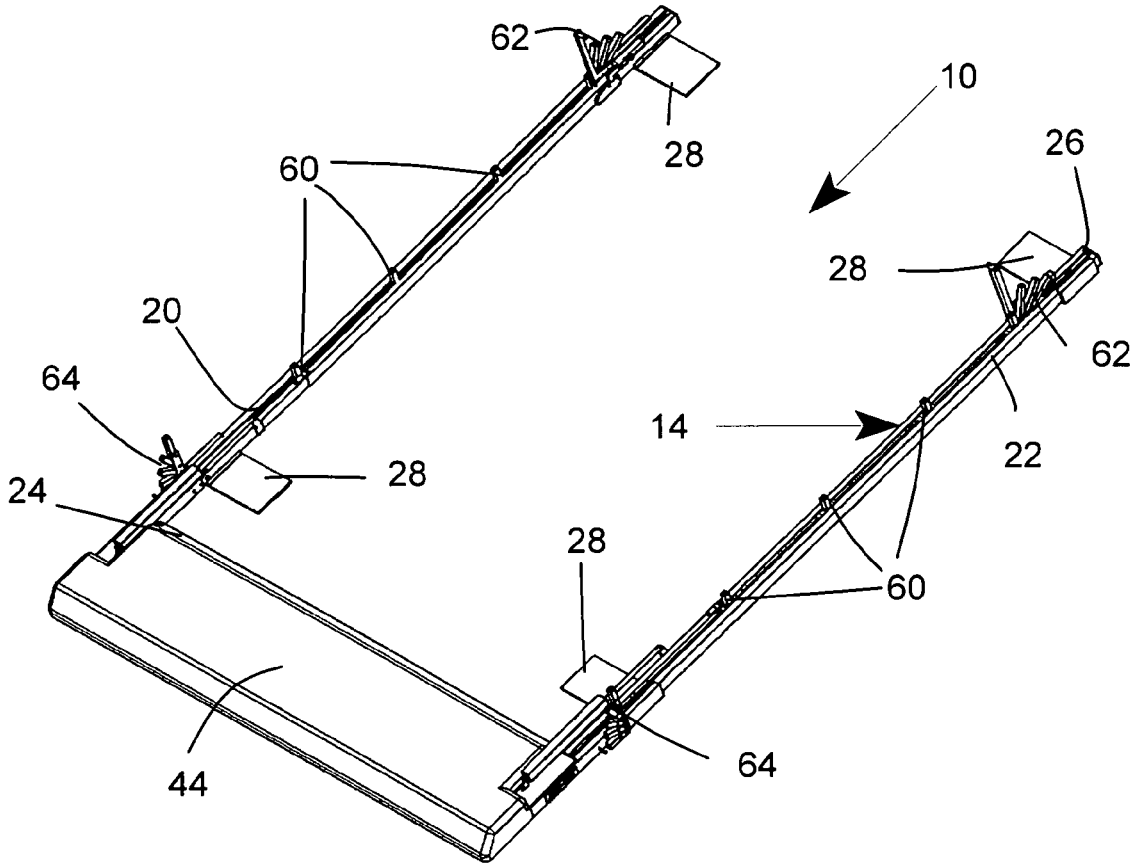
FIG. 2 is a view similar to FIG. 1 showing components of the frame in a deployed configuration.
Figure 3:
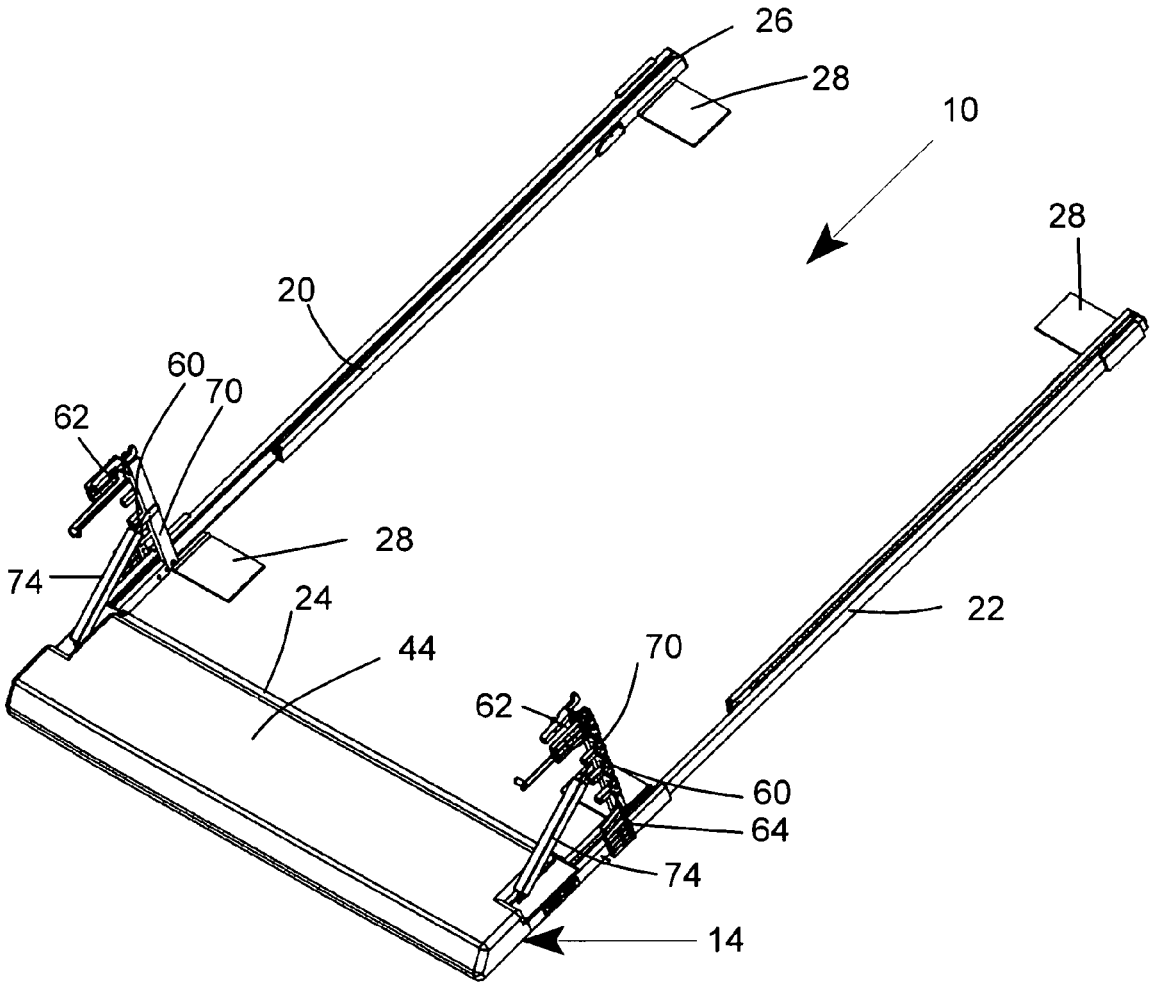
FIG. 3 is a view similar to FIGS. 1 and 2 showing components of the frame in a retracted configuration.

The rails 20, 22 and the pole holder subassemblies 60, 62, 64 mounted on the rails form a low profile subassembly that can lay on the ground or on a driveway or other surface where the vehicle or other movable object is to be located. A motor housing 44 extends between the rails 20,22 at the front end 24 and forms a part of this subassembly. Arched poles 50 supporting the canopy 12 can be mounted on this low profile, ground level subassembly. The ground frame 14 or subassembly without the poles 50 and canopy 12 is shown in FIGS. 1 through 3. FIG. 1 shows this frame subassembly 14 with the pole holder subassemblies 60 and 62 in a partially deployed configuration. FIG. 2 shows this subassembly 14 with the subassemblies 60, 62 and 64 in the fully deployed configuration. FIG. 3 shows this frame subassembly 14 in the retracted or collapsed configuration. This low profile, ground level frame subassembly 14 can be positioned at a desired location before the poles 50 and the canopy 12 are mounted on the pole holder subassemblies 60, 62, 64.

The left rail 20 and the right rail 22 are parallel tracks along which the subassemblies 60, 62 and 64 move. These rails 20 and 22 are spaced apart by a sufficient distance to permit a vehicle to be driven or moved between the rails 20, 22. The vehicle will enter through the rear end 26, and the motor housing 44 at the front end 24 can act as a front stop, since it is raised above ground level. Four pads 28 extend inwardly from the rails 20 and 22. These pads 28 are located so that an automobile or other vehicle can be positioned with the wheels on the pads 28 so that the shelter 10 will be firmly anchored in its deployed configuration, and high winds will not damage the shelter 10 or the vehicle positioned therein. The pads 28 can be moved along the rails 20, 22 so that the shelter 10 can be adjusted for use with vehicles of different sizes.

Figure 6:
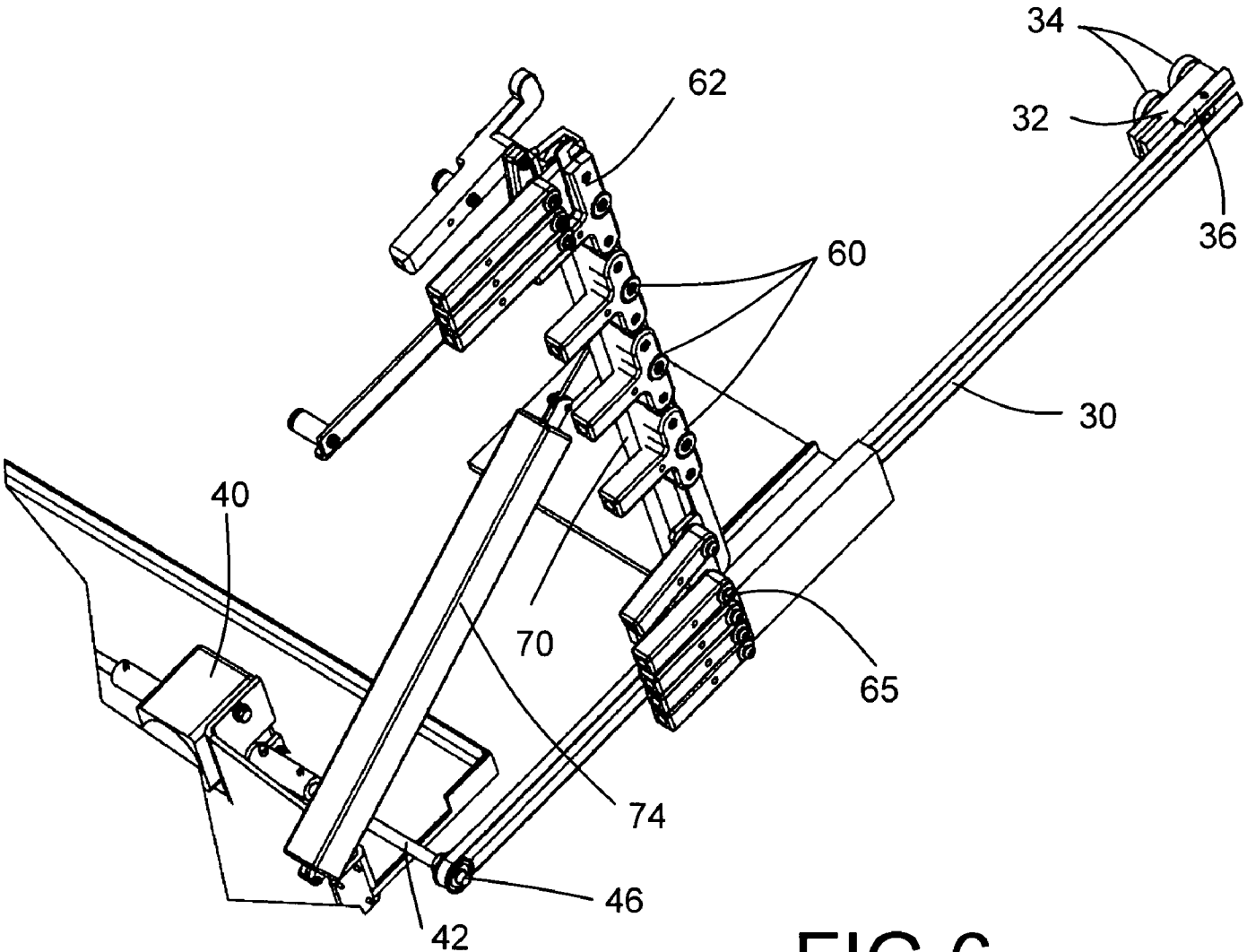
FIG. 6 is a view of the front end with the rail not shown, to show the elongate belt and the pulley driven by the electric drive motor and drive shaft.
Figures 14A, 14B, 14C:
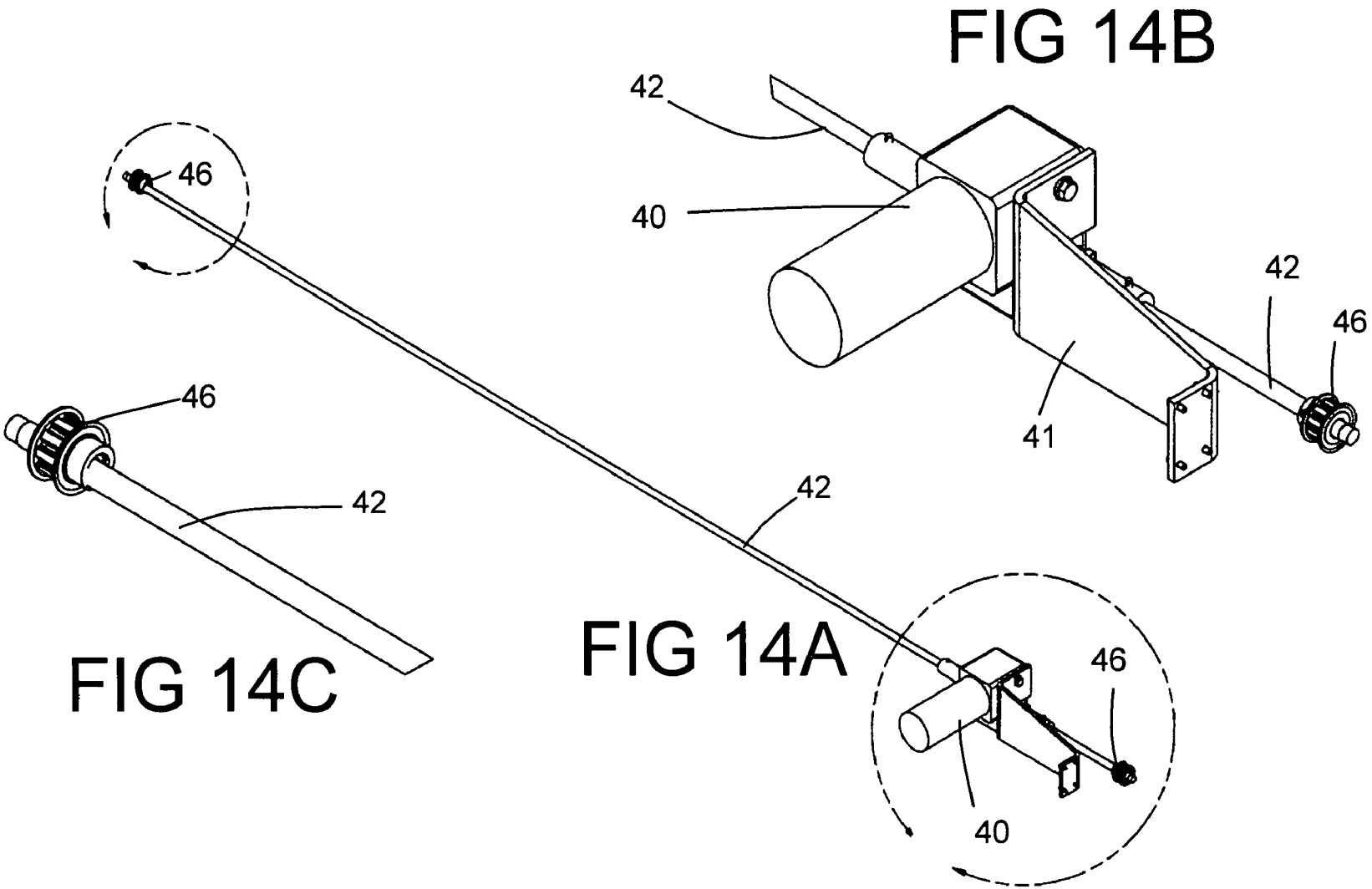
FIGS. 14A-14C are views of the main motor assembly that will be located at the front end of the rails and that will impart movement to the elongate belts in the rails.

A motor 40 and drive shaft 42, as shown in FIGS. 14A-14C will be positioned within the motor housing 44 as shown in FIG. 1. Rotation of this drive shaft 42 by the electric motor 40 will cause the rear pivoting pole holder subassembly 62 and the reciprocating main pole holder subassembly 60 to move between the front end 24 and the rear end 26 to erect or retract and collapse the canopy 12. Movable elongate members, preferably in the form of continuous belts 30, positioned in the rails 20 and 22 as shown in FIG. 6, will impart reciprocal movement to the subassemblies 60 and 62 as the drive shaft 42 rotates a drive pulley 46 to cause the belt to move along the rails 20 and 22. The rear subassembly 62 will be attached to the belts 30. Movement of the top part of these belts 30 from the front end 24 toward the rear end 26 will pull the rear subassembly 62 toward the rear end 26. Since the canopy 12 is mounted on arched poles 50 mounted to the rear subassembly 62 and to the reciprocating main subassembly 60, the main subassembly 60 will be drawn along the rails or tracks 20 and 22. When the rear subassembly 62 reaches the rear end 26, the main subassembly 60 will be in its fully deployed configuration and the portion of the canopy 12 supported by the main subassembly 60 will also be in its fully deployed position. As will be subsequently discussed in more detail, the pole holders 63 on the rear subassembly 62 can pivot when the rear subassembly 62 reaches the rear end 26. If this pivoting action is employed to fully close the shelter 10 at the rear end 26, the canopy 12 at the rear end 26 will continue to move in a pivotal manner after the main subassembly 60 has reached its fully deployed configuration. It should be understood that some embodiments may dispense with the pivoting rear assembly, but this will leave the interior of the shelter 10 subject to wind, which could damage the shelter 10 and the vehicle stored therein.

The front subassembly 64 comprises a series of pole holders 65, which are attached to the rails 20 and 22. Therefore the front pole holders 65 do not traverse along the rails 20 and 22, as do the main subassembly 60 and the rear subassembly 62. The front pole holders 65 instead pivot as the rear subassembly 62 and the main subassembly 60 move from the front end 24 toward the rear end 28. Since the canopy 12 is attached to the poles 50 mounted on the front pole holders 65, movement of the arched poles 50 mounted on the rear subassembly 62 and the main subassembly 60 will cause the canopy 12 to pull the front poles from a generally horizontal retracted position upward into an inclined upright orientation. When the rear subassembly 62 reaches the rear end 26, the front subassembly 62 and the main subassembly 60 will both have reached their fully deployed position in which the front and the top of the stored vehicle or object will be covered. At this point the rear pole holders 63 will then be pivoted from an upright position, similar to that of the main pole holders 61 into a fully deployed horizontal position to close the rear end 26 of the shelter 10. The rear end can be manually closed by merely pulling down one of the rear end poles 60, and a strap can be provided for convenience. Alternatively, a powered mechanism may be employed, in a manner to be subsequently discussed in more detail, to fully close the rear end 26 of shelter 10.

Figure 5:
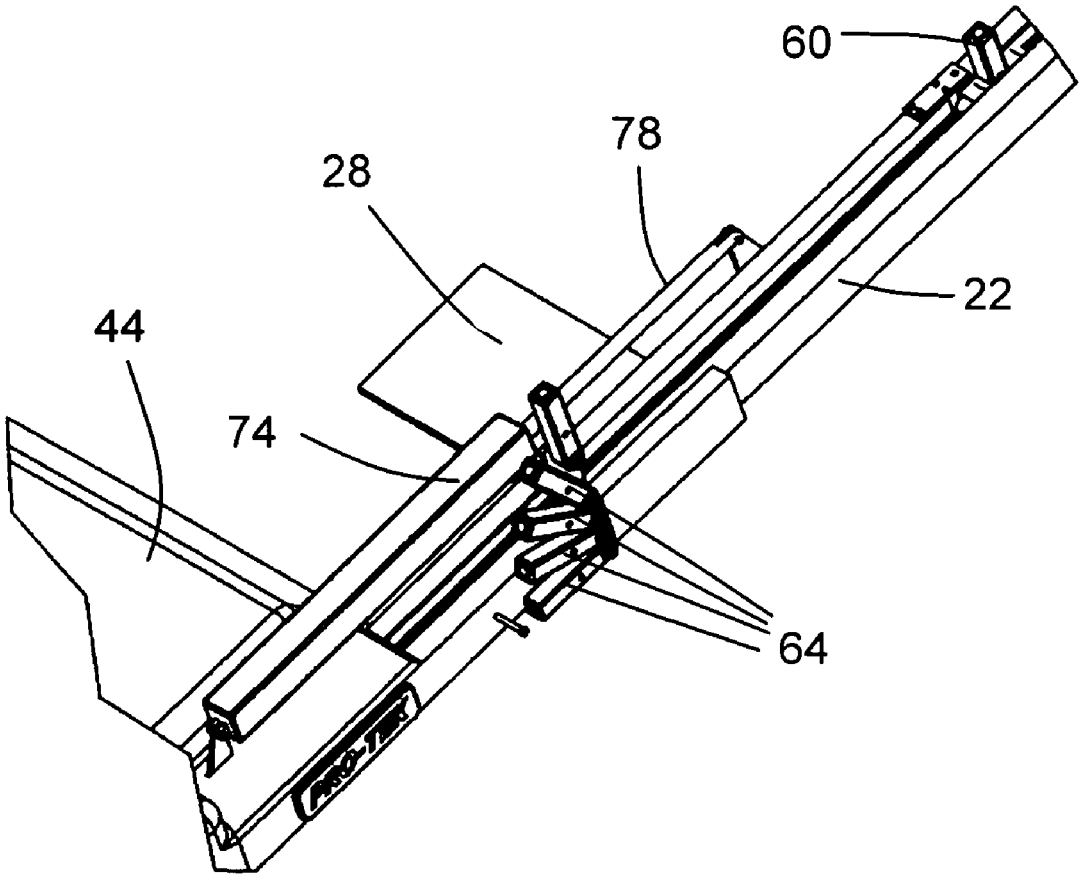
FIG. 5 is a partial view of the swing arm of FIG. 4 in the deployed configuration.

The shelter 10 can be moved from its fully deployed or closed configuration to its retracted position in which the poles 50 and canopy 12 would be stacked in a collapsed configuration by reversing the previous steps. First the rear poles 60 on the rear subassembly 62 would be raised from a fully deployed configuration to an upright position at the rear end 26. This could be done either manually or this initial retraction could be powered. Since at least one subassembly would be attached to the endless belts 30, rotation of the drive shaft 42 in an opposite direction will draw the top part of the belts 30 toward the front end 24 of the shelter 10. The rear subassembly 62 and the main subassembly 60 will then move toward the front end 24, and the canopy 12 will collapse as the poles 50 mounted on the subassemblies 60 and 62 move together and collect. The poles 50 will move toward the front end 24 in an upright position as the belts 30 return. Once the subassemblies 60 and 62 return to the front of the shelter 24, the belts 30 will stop. This position is shown in FIG. 5. Further movement of the poles 50 and canopy 12 to the fully retracted or collapsed position is not accomplished by movement of belts 30 or the drive shaft 42 and is not completed by the motor 40.

Figure 4:
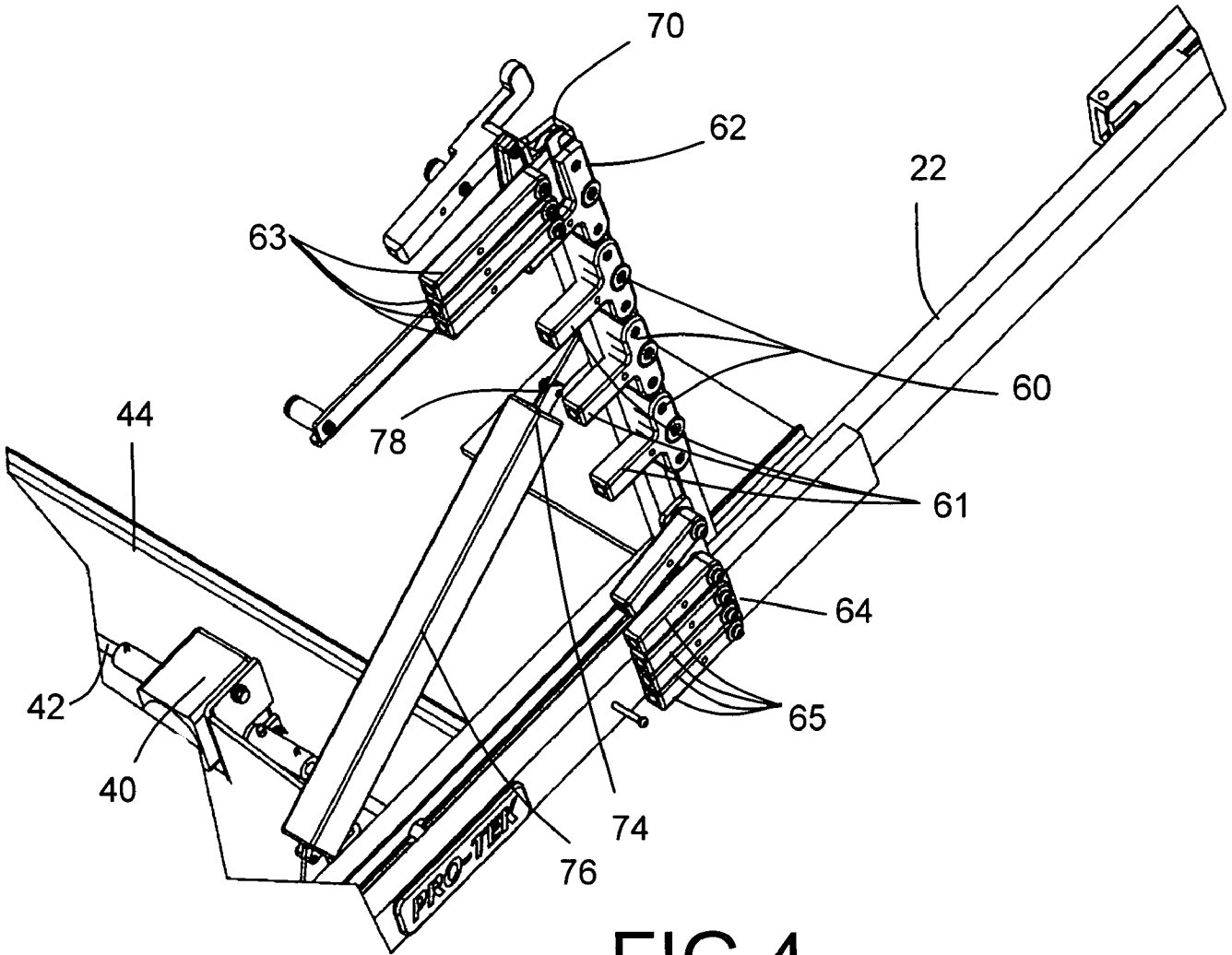
FIG. 4 is a more detailed view of a swing arm, which comprises part of the frame, in the retracted configuration of FIG. 3.

Complete retraction follows the return of the pole holder subassemblies 60 and 62 to the front end 24 d when linear reciprocal movement has been completed. The subassemblies 60 and 62 will be positioned on swing arms 70, which in the configurations shown in FIGS. 1 and 2 are aligned with the rails 20 and 22. These swing arms 70 are attached to the rails 20 and 22 at a front end of the swing arm 70 as shown in FIG. 4. Swing arms 70 have the same shape as the rails 20 and 22 so that the subassemblies 60 and 62 can ride on the swing arms 70 in the same manner as on the rails 20 and 22.

Each swing arm is attached a linear actuator subassembly 74, which includes an actuator housing 76 and an actuator piston 78. The linear actuator 74 can comprises a commercially available electrically powered actuator, such as that provided by Firgelli Automations under the part number FA-05-12-X, although other linear actuators may be substituted. Hydraulic actuators could be used instead of electrically powered actuators. As the piston 78 is extended relative to the housing 76, the swing arm will rotate into alignment with the rails 20 and 22 in the configuration shown in FIGS. 1 and 2. As the piston 78 is drawn into the housing 76, the length of the linear actuator 74 will decrease causing the swing arm 70 to which it is attached to move from the aligned, horizontal configuration shown in FIGS. 1, 2 and FIG. 5 to the retracted position shown in FIGS. 3 and 4. With the swing arms 70 in this upright position, the pole holders 61 and 63 will be in a horizontal position extending from the swing arms 70 toward the front of the shelter 10 and beyond the motor housing 44. Movement of the swing arms 70 to the configuration shown in FIG. 4 will cause the poles 60 to stack up and will collapse the canopy 12. The shelter 10 will then be in the fully retracted or collapsed configuration shown in FIG. 19.

Figure 8:
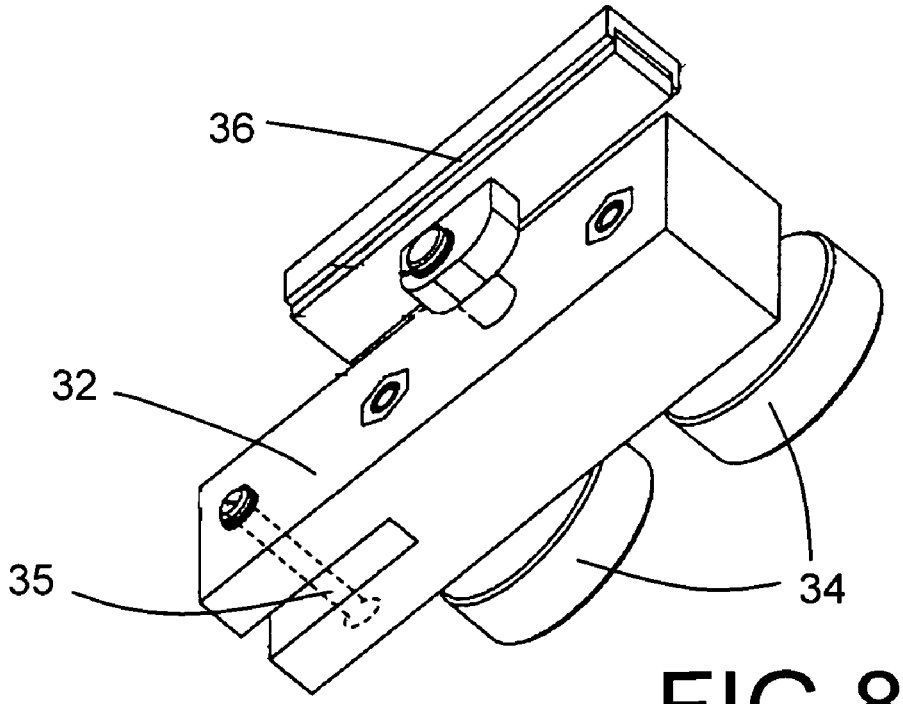
FIG. 8 is a view of the belt traveler that is attached to the belt to move the pole holding subassemblies along the rails.

In FIG. 4, the rear subassembly 62 is located at the distal or top end of the swing arm 70. In FIG. 4 the components of rear subassembly are shown in the retracted position in which they will extend horizontally and parallel to the rail 22. In FIG. 5, the pole holders 63 forming the rear subassembly will be in a fanned configuration to support the rear end of the canopy 12, as shown in FIG. 20. One upright pole holder 61, of the type used on the main reciprocating subassembly 60 extends upwardly in FIG. 17. All of the pole holders 61, 63 and 65 comprise short supports on which the arched poles 50 will be mounted, either by inserting the poles into the pole holders or the other way around. The rear subassembly 62 has wheels 66, which will engage the corresponding rail 20 or 22 on which the rear subassembly 62 is located so that the rear subassembly 62 can reciprocate in a rearward or forward direction depending upon the movement of the movable elongate member or belt 30. In addition to the pole holders, the rear subassembly 62 includes a latch 72 at its rearmost end. The latch 72 has a lower U-shaped section that will engage a pin (not shown) extending across a slot in a belt traveler 32 on the belt 30 when the swing arm 70 is rotated to the aligned position shown in FIG. 5. With the pin in the belt traveler 32, shown in FIG. 8 is trapped in the U-shaped section of latch 72, the rear subassembly 62 will be drawn in the direction of movement of the belt 30 so that it can move either towards the rear end 26 for deployment or toward the front end 24 for retraction. Since the arched poles 50 on the main reciprocating subassembly 60 are attached to poles on the rear subassembly 62 by the canopy 12, as shown in FIG. 20, the main reciprocating subassembly 60 will be drawn along with the rear subassembly 62.

Figure 11B:
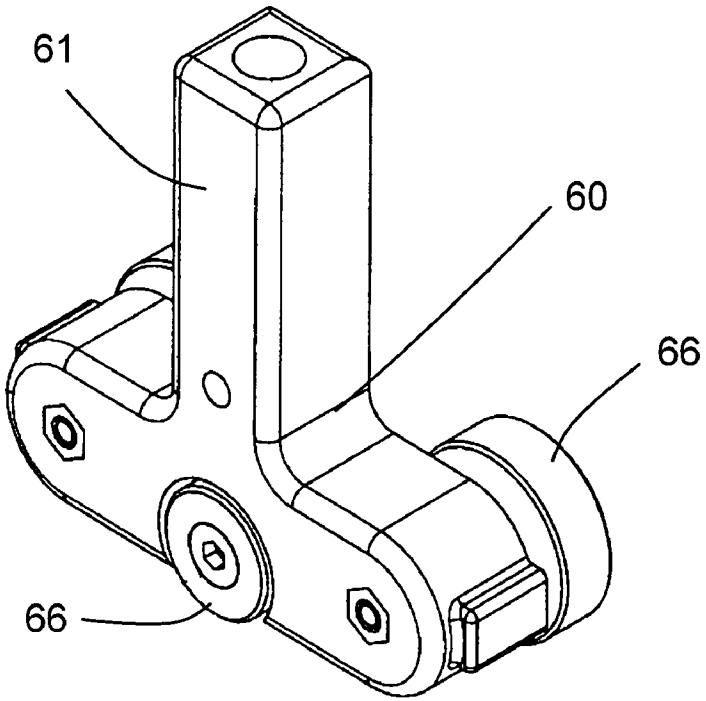
FIGS. 11A and 11B are three dimensional views showing opposite sides of one of the main reciprocating trolleys that move along the rails.
Figure 11A:
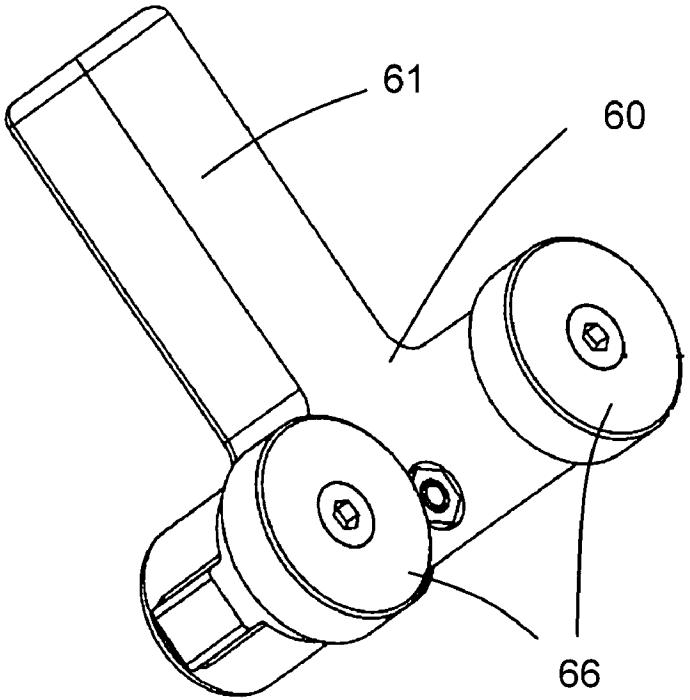

The main reciprocating subassembly 60 comprises three trolley sections of substantially the same shape as the trolley section employed in the rear subassembly 62. The trolley sections of main subassembly 60 do not have pivoting pole holders 63 as shown in FIGS. 11A and 11B. The pole holders 61 in the main trolley sections are upright pole supports 61. When the main reciprocating subassembly 60 is in the aligned configuration of FIGS. 1, 2 and 5, the arched poles 50 and the pole holders 61 in the main subassembly 60 will move only linearly so that they will reciprocate between the front end 24 and the rear end 26 of the frame and of the shelter 10. In the retracted position, rotation of the swing arms 70 will bring the pole holders 61 and the arched poles 60 mounted thereon into a horizontal position so that the poles 60 and the canopy can be positioned in the retracted or collapsed configuration of FIG. 19.

The front trolley subassembly 64 does not actually reciprocate along the rails 20 or 22, and is not attached directly to either the rails or to the swing arm 70. This front subassembly 64 is referred to as a subassembly because it does include a series of pole holder rods 65 that move with the canopy 12 during deployment or retraction of the shelter 10. It is the movement of the swing arms 70 caused by actuation of the linear actuator 74 that imparts movement to the poles 50 attached to the front subassembly 64. Actuation of the linear actuator 74 occurs before engagement of the motor 40 when the shelter 10 is to be moved from the retracted configuration shown in FIG. 19 to the fully deployed configuration shown in FIG. 20. When the shelter 10 is returned from the deployed configuration to the retracted configuration, the linear actuator 74 is engaged after the motor 40 and the belts 30 have returned the trolley subassemblies 60 and 62 to the front end 24 of the shelter 10, substantially in the position shown in FIG. 5.

FIG. 6 shows the swing arm 70 and the pole holding subassemblies in the same configuration as in FIG. 4. FIG. 6 does not represent an actual configuration of the shelter 10 or its subassemblies because the rail is not show so that the moveable elongate member in the form of the belt 30 can be seen. The drive pulley 46 mounted the drive shaft 42 is shown engaging one end of belt 30. Only the front portion of belt 30 is shown. The belt 30 travels in the belt channel 23 extending between opposite ends of the rail 20, with one end of this belt channel 23 shown in FIG. 7. A belt traveler 32 is attached to the belt 30 by a clamp 36 that is shown in more detail in FIG. 8. As the belt 30 moves, the belt traveler 32 clamped thereto will also move. Belt traveler 32 has two wheels 34 that will travel in the rail wheel slot 21. A pin 35 extends across a slot on the front end of the belt traveler 32, so that when the latch 72, seen in FIG. 12B, enters the slot to engage the pin 35, the front trolley subassembly 62 will be attached to the belt traveler 32 and therefore to the belt 30. When the swing arm 70 moves from the position shown in FIG. 4 to that shown in FIG. 5, the latch 72 will engage the pin 35 and will be disengaged by movement in the opposite direction.

Figure 9:
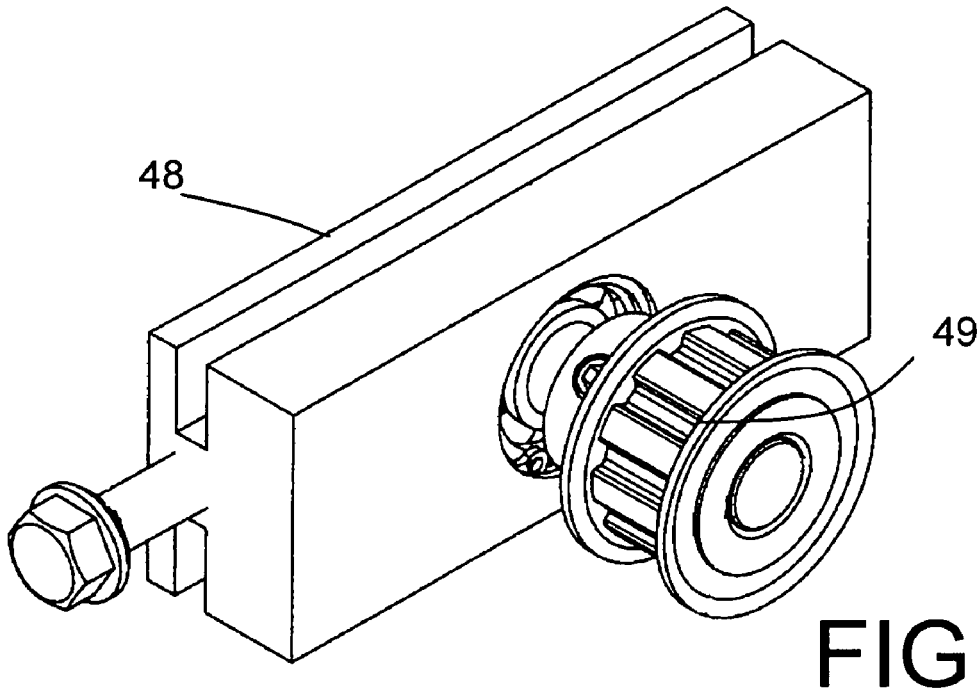
FIG. 9 is a view of the belt tensioner and the tensioner pulley on which the belt is mounted at the rear end of the frame subassembly.

A belt tensioner 48 and a belt tensioner pulley 49 are located on the opposite end of belt 30 at the rear end 26 of the frame assembly 14. Belt tensioner 48 is shown in FIG. 9.

Figure 10:
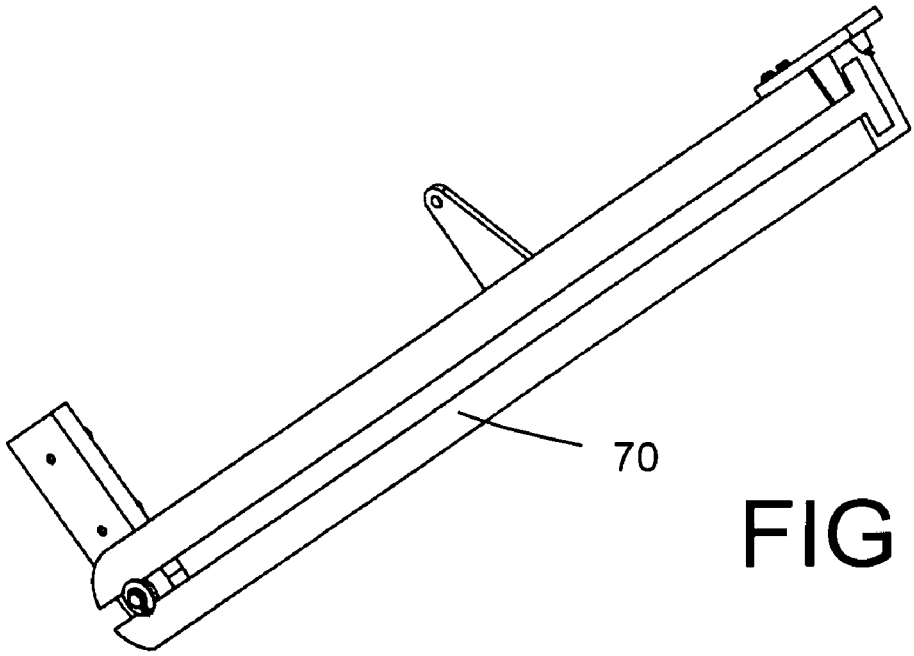
FIG. 10 is a view of the swing arm.

FIG. 10 shows the swing arm 10, without the trolley subassemblies mounted thereon.

Figure 7:
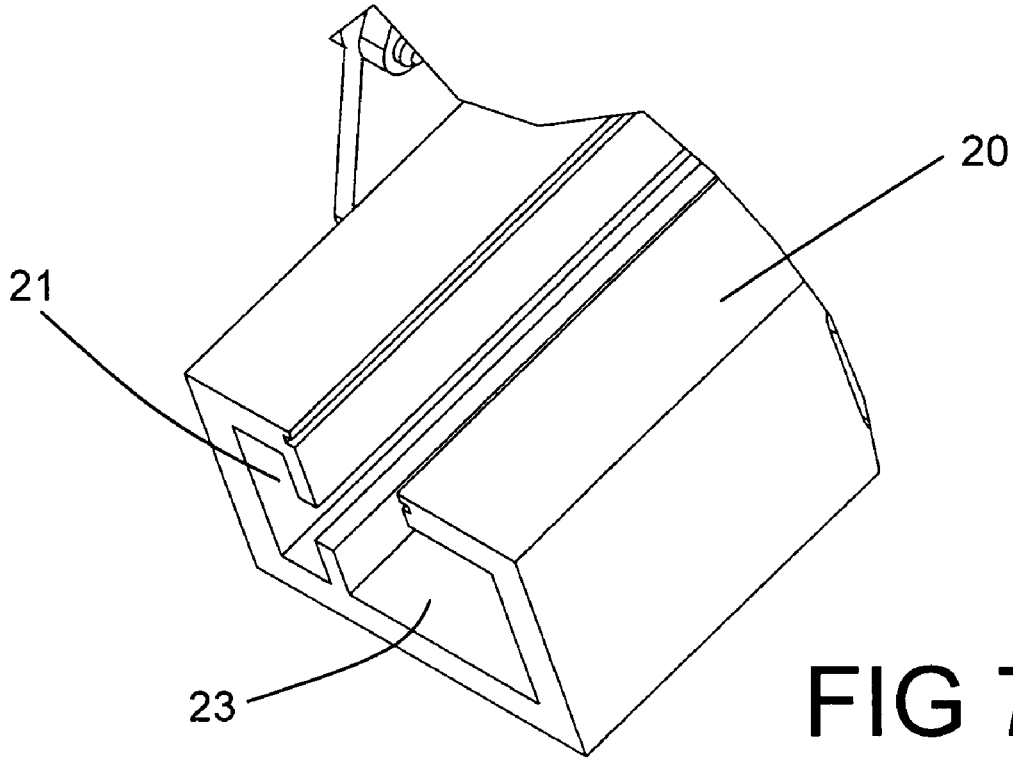
FIG. 7 is a view of an end of the rail housing showing two slots or channels that run the length of the rail.

An individual main trolley member, which together with other similar members, forms the main reciprocating subassembly 60 is shown in FIGS. 11A and 11B. Each individual trolley member 60 includes wheels 66 that will travel in the rail wheel channel or slot 21 of the rails 20 and 22. The individual trolley members 40 have a generally T-shaped configuration with a pole holder 61 extending above the wheels 66 will extend through an opening above the belt channel 23, which is shown in FIG. 7. The individual trolleys 60 are not attached directly to the belt 30. The canopy 12 that will be mounted on the arched pole 50 mounted on pole holder 61 will pull the individual main trolley member and the main trolley subassemblies 60 along the rails 20 and 22, so that the poles 50 and the pole holding trolleys 60 will reciprocated relative to rails 20 and 22.

Figure 12B:
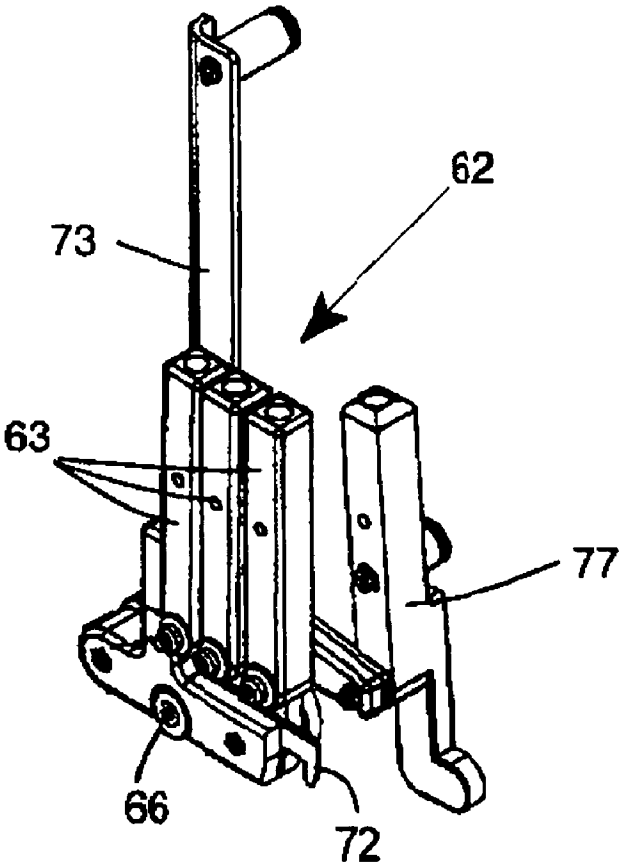
FIGS. 12A and 12B are three dimensional views showing opposite sides of the rear trolley subassembly.
Figure 12A:
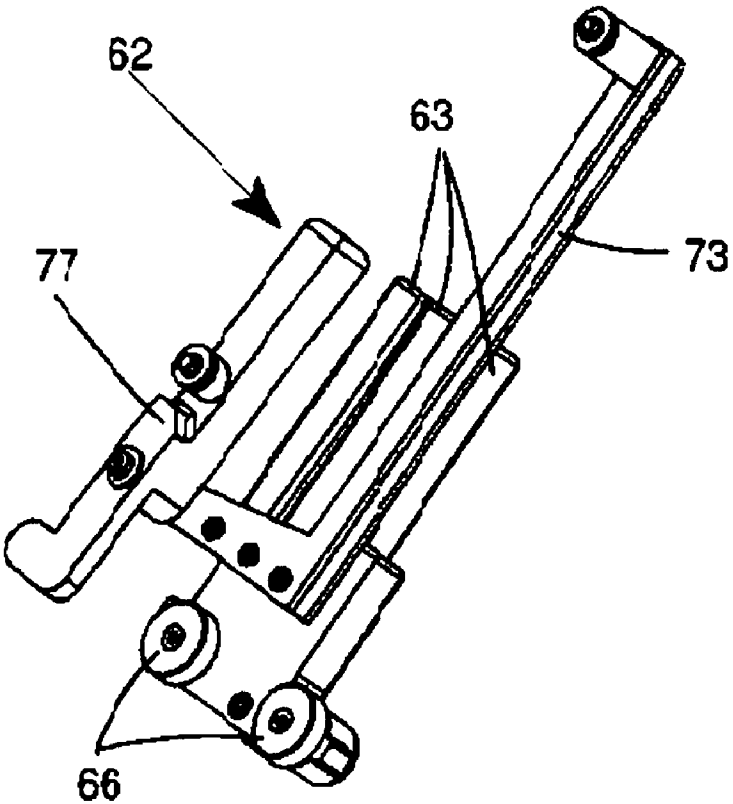

The rear pivoting subassembly 62, located between the main reciprocating subassemblies 60 and the rear of the frame 14, is shown in FIGS. 12A and 12B. Rear trolleys 62 include wheels 66 and pivoting pole holders 63 that can rotate relative to the trolley base as shown in FIG. 2. The U-shaped latch 72, which will engage pin 35 to pull the rear trolley subassembly 62 and the main trolley subassembly along rails 20 and 22 is shown in FIG. 12B. Pole holders 63 pivot about the trolley base so that the poles 50 mounted thereon can rotate between an upright configuration, in which they will traverse along rails 20 and 22 and a fully deployed configuration covering the rear of a sheltered vehicle as shown in FIG. 20. Rear pivoting subassembly 62 also includes a handle 73 which can allow the rear pivoting subassembly 62 to be manually pulled along the rails 20, 22, and a finger 77 which can engage a protrusion on the rails 20, 22 at the rear end 26 acting as a stop.

FIGS. 13A and 13B show the front subassembly 64, which includes pole holders 65 mounted on a bracket 67, that is in turn mounted to the rails 20 and 22 at the rear end 24. The pole holders 65, and the poles 50 mounted thereon, can thus rotate relative to the rails 20 and 22 so that the canopy mounted thereon can cover the front end in the deployed configuration and can return to a generally horizontal position when in the retracted or collapsed position as shown in FIG. 19.

In the preferred embodiment of this invention, the belts 30 and the subassemblies 60, 62 and 64 are moved by a motor 40 located at the front of the frame 14. The motor 40 comprises a conventional electric motor that drives a drive shaft 42 connected to belts 30 in each rail or track 20, 22 by pulleys 46. The motor 40 drives the pulleys 46 through a worm gear so that the subassemblies remain in a stable position unless driven by the motor 40. The motor 40 thus drives both belts simultaneously, so that movement of the main pole holder subassembly 60 and the rear pole holder subassembly 64 is simultaneous. The poles 50 and the canopy 12 will thus move without becoming cocked or disoriented relative to the parallel rails 20, 22. The motor 40 is mounted at the front end 24 of rail 22 by a frame 41. The portion of the drive shaft 42 extending toward the opposite rail 20 can be attached to the opposite side of the motor 40. The pulleys 46 can be inserted into the front end of belts 30, which are already mounted in rails 20, 22 at the time the motor 40 and drive shaft are assembled to the rails 20 and 22. Upper and lower housing sections form a motor housing 44, located at front end 24, which not only houses the motor assembly, but also serves as a front stop for a motor vehicle when it is driven into place between the two rails 20, 22. When the shelter 10 is in the collapsed or retracted position shown in FIG. 19, the canopy 12 and the top of the poles 50 will extend beyond the housing 44 and will flank the housing 44. In the preferred embodiment of this invention, the electric motor 40 and the linear actuator 74 and the rear actuator (to be discussed subsequently) employ rechargeable batteries as a power source. These batteries can be rechargeable, and would preferably be recharged by solar power. Optionally a drop cord attachable to AC power can also be employed. The batteries can also be recharged from a standard AC source, and the AC choice can power the motors through a transformer when the batteries are low.

Figure 15:
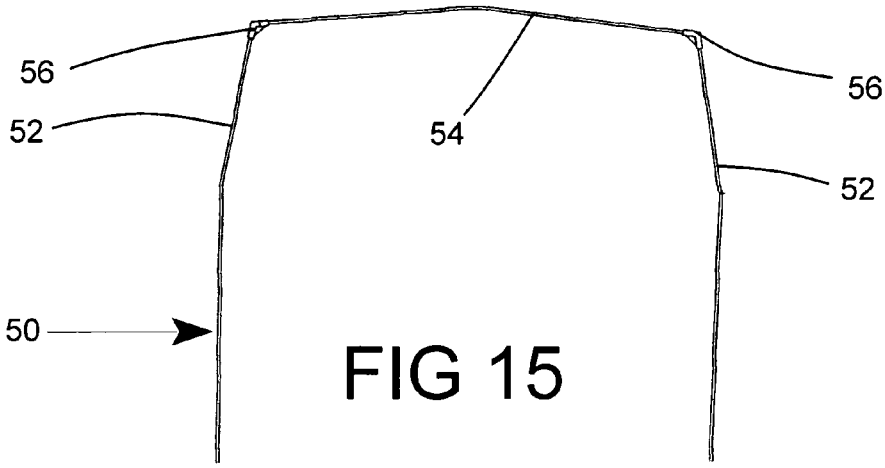
FIG. 15 is a view of one of the arched poles in an assembled configuration.

FIG. 15 shows one of the arched poles 50. Each pole 60 has three sections. End sections 52 are joined to a center section 54 by corner brackets 56. Once assembled in this manner the poles 50 can be attached to the lower surface of a pliable canopy 12 in a number of different ways. In one embodiment pockets can be formed between opposite side edges of the canopy 12, and the poles 50 can be inserted through these pockets. After the poles 50 have been attached to the canopy 12, the ends of each pole 50 can be mounted or attached to corresponding pole holders 61, 63 and 65 in subassemblies 60, 62 and 64 respectively.

Figure 16:
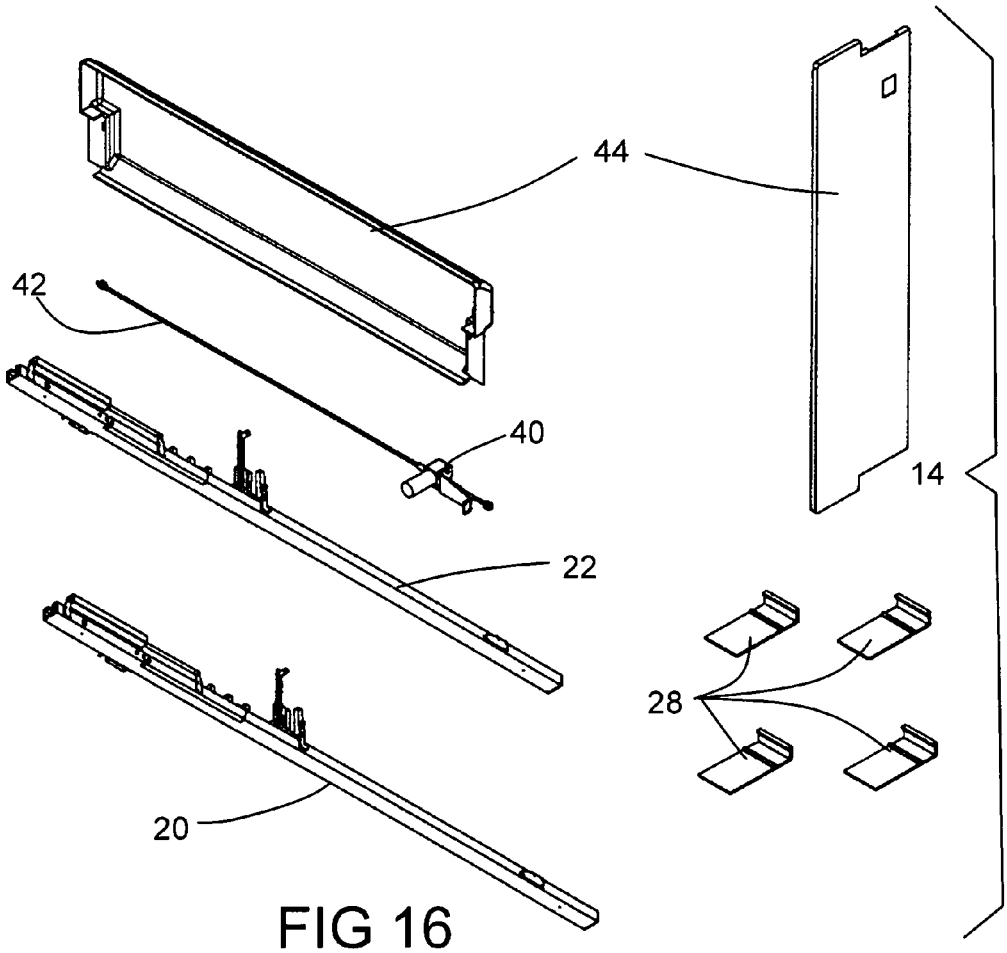
FIG. 16 is a view of the components of the frame in the manner that they would be shipped for on site assembly.

FIG. 16, in combination with FIG. 15, shows the main structural subassemblies that can be assembled on site. The subassemblies shown in FIG. 16, along with pole sections 52 and 54 are shipped to the site or can be transported to the site where the shelter 10 will be assembled. Rails 20, 22 are preassembled with the belt 30 and the traveling subassemblies 60, 62 and 64 assembled to the rails 20, 22 and 24. The swing arm 70 would be preassembled in the aligned position. The motor 40 and drive shaft 42 subassembly is shipped with the bracket mounting the motor to the rail 22, and the portion of the drive shaft 42 that is to extend to the rail 20 is subsequently attached to the motor 40. Pulleys 46 can then be inserted into engagement with the belts 30, and a belt tensioner 48 located at the opposite end of the belt 30 can take up any slack in the belts 30. The housing sections can be assembled over the motor 40 and drive shaft 42 between rails 20, 22 to cover the motor subassembly. The stops 28 can then be mounted on the rails 20, 22 to coincide with the wheel base of the vehicle to be stored in shelter 10.

Figure 17:
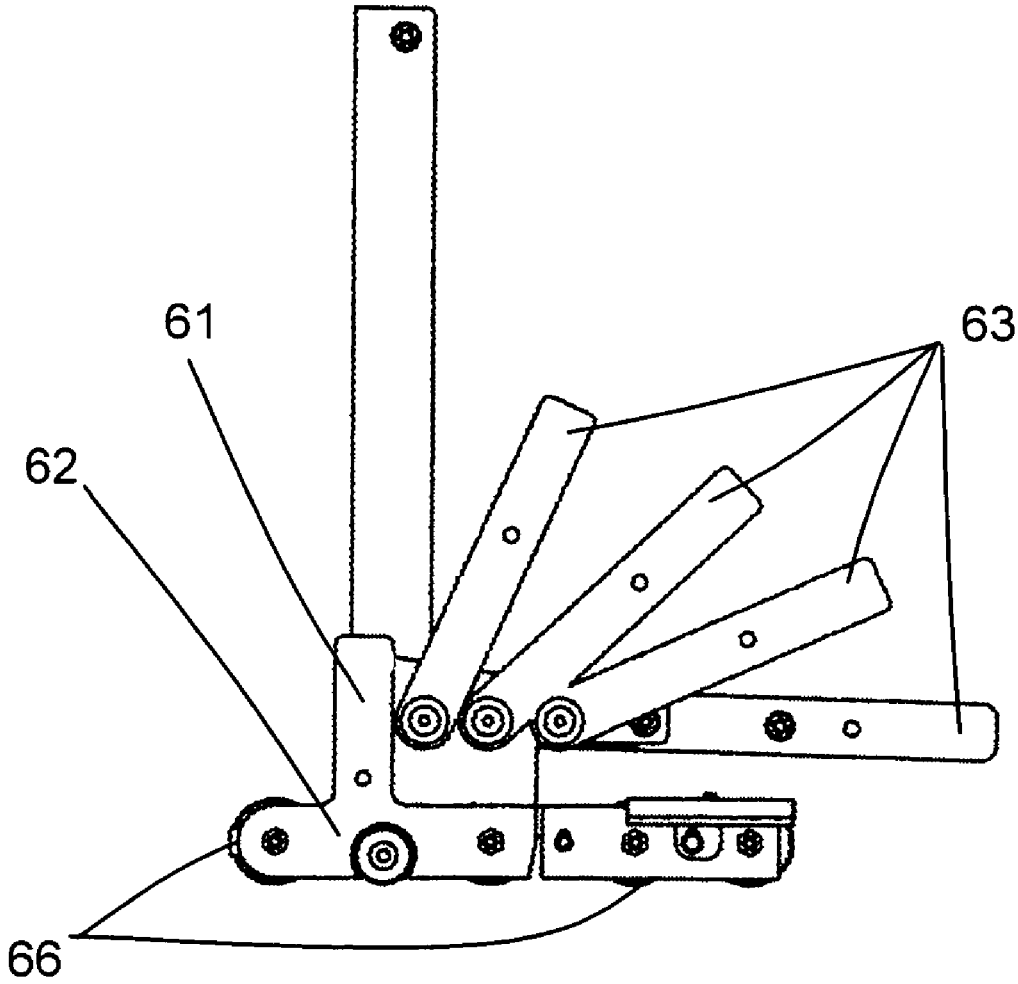
FIG. 17 shows the rear pole holders in a deployed configuration.

In the embodiment depicted in FIGS. 1-6, the main traveler subassemblies 60 can be moved to its deployed position by the motor 40, and the rear traveler subassembly 62 can be moved to the front end 26 of the rails or tracks 20, 22. The motor 40 will not however rotate the poles 50 attached to rear pivoting pole holders 63 to their fully deployed configuration in which the rear section of the canopy will cover the vehicle or object to be covered by the shelter. The position of the pivoting pole holders 63 in their fully deployed configuration is shown in FIG. 17. In the embodiment depicted in the previous figures, the rear pivoting poles can be manually rotated down to their fully deployed configuration in which the rear of the shelter 10 is completely enclosed as shown in FIG. 20.

Figure 18A:
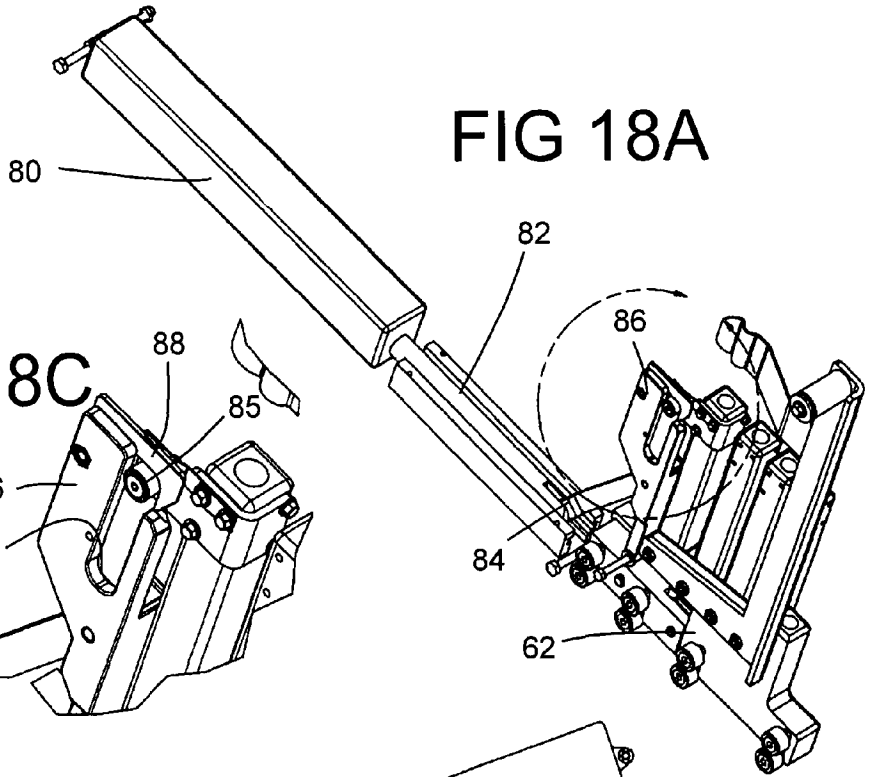
FIG. 18A-18C shows an automated subassembly that can be added to the basic frame assembly so that the rear poles can be automatically raised and lower.
Figure 18C:
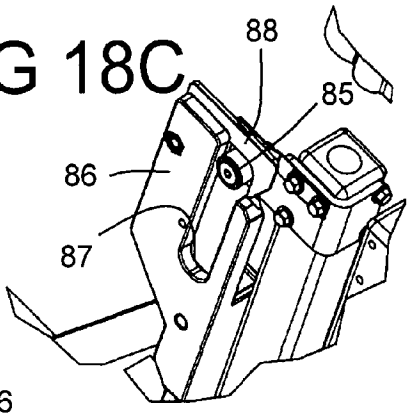
Figure 18B:
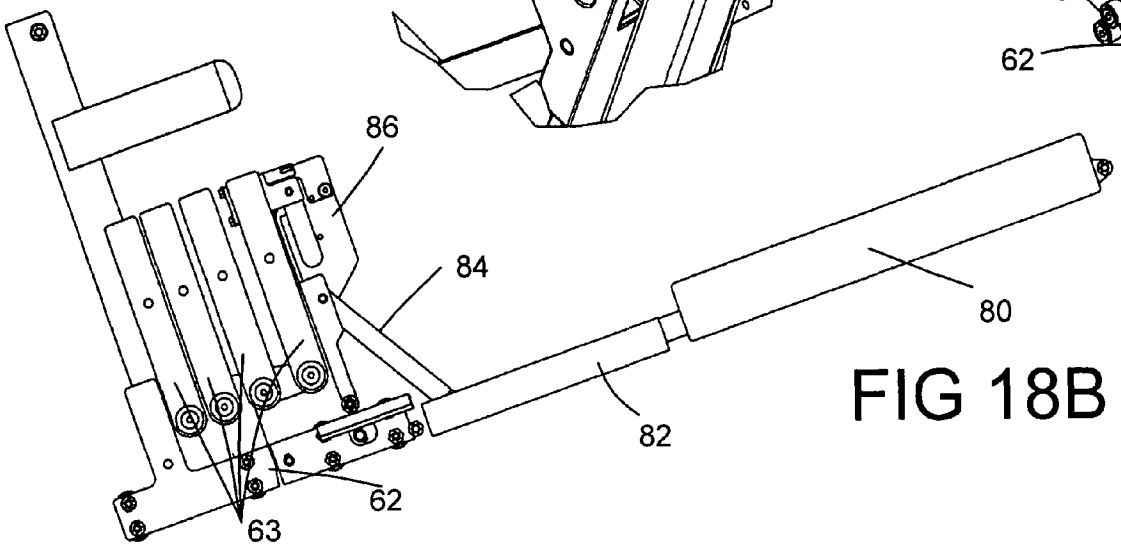

An alternative to manually closing the rear section of the canopy 12 is shown in FIGS. 18A, 18B and 18C. In this fully automatic embodiment, a rear linear actuator 80 having a rear actuator piston 82 is located at the rear end 26 of the rails 20, 22. The rear linear actuator 80 can be the same type of actuator as the front linear actuator 74. The rear linear actuator 80 is located to the rear of the rear pivoting pole holder subassembly 62 when it is fully extended at the rear end 26. The rear linear actuator 80 is fixed to the rails 20, 22 at their rear end 26, and it does not reciprocate or traverse along the rails when the canopy is moved between the retracted and deployed configurations. As shown in FIGS. 18A and 18B, the pole holders 63 are still in their upright position, and have not been fully extended to the fully deployed position shown in FIGS. 17 and 20. FIGS. 18A-18C, however show the rear pole holder subassembly 62 attached to the linear actuator 80 by a pin 85 which resides in a slot 87 on a pivoting fork member 86 that pivots relative to the rails 20, 22, but is not part of the linearly moving pole holder subassembly 62. This pivoting fork member 86 is also attached to a link 84 whose opposite end is attached to the rear linear actuator piston 82. In the position shown in FIG. 18A, the pin 85, which is part of the automated version of the movable pole holder subassembly 62 is held in the slot 87 by a spring latching finger 88. The pin 85 will move up and down in slot 87 as the linear actuator piston 82 is retracted or extended, pulling or pushing the pivoting fork 86. In the position shown in FIG. 18A, retraction of the rear actuator piston 82 will cause the fork 86 to move from its upright position to an angled and then a horizontal position, in which the rear of the canopy will be fully deployed, and the individual pole holders 63 will be in substantially the same position as shown in FIG. 17. To move the pole holders 63 back to the upright position, the rear actuator piston is extended and the link 84 will return to an angled position in which the pivoting fork 86 is also in its upright position. The spring latching finger 88 will hold the pin 85 in slot 87 during this movement. To disengage the latching spring finger 88, the link 84 moves toward a more upright position by continued movement of the rear linear actuator piston 82 from the position shown in FIG. 18A, and a projection (not shown) will continue upward to engage the spring latching finger 88 upward to release the pin 85 from the slot 87. In this manner the rear pole holder subassembly 62 will be disengaged from the rear linear actuator 80, so that it can move toward the front end 24 of the rails to the position shown in FIG. 5. When the rear pivoting pole holder assembly 62 is returned to the rear end 26, the pin 85 will engage the spring latch finger 88, caming it upwardly until the pin 85 is returned to the latched position shown in FIGS. 18A-18C.

Although the preferred embodiments of this invention have been described for use in sheltering or covering a motor vehicle, such as an expensive or vintage automobile, it should be understood that it is not limited to this application. For example, the shelter according to this invention can be used as a mini-boat garage, and can be erected over a boat slip in a dock or on a pier. In such an application, the shelter or cover may not completely cover the boat, but it will cover those portions of the boat above the surface of the deck. This invention could also be employed to cover tractors or other farm machinery or other larger vehicles.

One significant advantage of this invention is that the basic components are scalable, so that the same approach can be used for small objects, such as a sports car, and for larger objects such as a truck. In some cases the length of the rails can be increased to cover a longer vehicle, and additional components can be added. For example to increase the length of a cover, it would only be necessary to add additional poles to support a larger cover and to increase the length of the rails, as well as the belts extending through the rails.

This shelter is also portable so that it can be easily moved from place to place, either in its assembled configuration or by disconnecting the parts for shipment in the same manner as the original product is provided.

One problem that might be encountered is the build up of particulate debris, such as small rocks, dirt and twigs on the rails 20, and 22. If sufficient particulate debris is accumulated on or in the rails or tracks it might interfere with movement of the sliding subassemblies along rails 20 and 22. In order to prevent such accumulation a plow can be mounted on the leading edge of the rear traveling subassembly 62 as it moves toward the rear end 26. Such a plow would push the debris out of the way and prevent binding. A plow could also be mounted on the main sliding subassembly 60, so that it would precede movement back toward the front end 24.

The embodiments described herein are intended to be representative only and the invention is not limited to these embodiments. One of ordinary skill would recognize that modifications can be made to these representative embodiments without departing from the scope of the invention which is defined by the claims.

The invention claimed is:

1. A retractable shelter shiftable between a horizontal stored position and a deployed position, the shelter comprising:

a pair of rails;

a movable elongate member reciprocal along each of the rails;

a plurality of poles slidable along the rails in response to reciprocal movement of the elongate members to which at least one pole along each rail is attached, each pole extending between the rails and supporting a pliable canopy, wherein the poles are rotatable at one end of the rails between the horizontal stored position and an upright configuration, the poles being movable in the upright configuration, toward an opposite end of the rails to the deployed position;

wherein each pole is mounted on a pole holding member having pulleys rotating as the pole holding members move along the rail on which the pole holding member is mounted; and wherein the pole holding members are positioned on swing arms located at the one end of the rails so that the swing arms pivot to move the poles mounted on pole holding members between the horizontal storage position and the upright configuration,, and wherein the pole holding members are pivotal with the poles mounted thereon with the pole holding members being mounted on the tracks at the one end, the swing arms being rotatable independently of the pivoting pole holding members, the poles rotating toward an upright position as the elongate members move toward the opposite end of the tracks by movement of the pliable canopy.

2. The retractable shelter of claim 1 wherein the poles are movable in an upright position from the deployed position toward the one end of the rails where the poles are rotatable to the horizontal stored position.

3. The retractable shelter of claim 1 wherein a motor driven drive shaft extends between the rails at the one end of the rails, the drive shaft imparting simultaneous reciprocal motion to the elongate members moving along both rails.

4. The retractable shelter of claim 3 wherein a single motor imparts rotation to the drive shaft in opposite directions.

5. The retractable shelter of claim 1 wherein each pole is removable from each pole holding member on which the pole is mounted.

6. The retractable shelter of claim 5 wherein each pole forms an arch, with opposite ends of each pole being mounted on the pole holding members mounted on both tracks.

7. A motor vehicle shelter movable from a stored position to a deployed position to shelter a motor vehicle, the shelter comprising:

a canopy supported by arched, spaced poles when the shelter is in the deployed position, the canopy being collapsible as the poles are retracted to the stored position;

reciprocating pole holders reciprocal linearly with the arched, spaced poles mounted thereon in an upright position between a front end and a rear end of the motor vehicle shelter;

front pole holders rotating from a horizontal position toward more upright positions as the canopy is pulled by movement of the reciprocating pole holders to the deployed position to cover a motor vehicle in the deployed position;

rear pole holders rotating from an upright configuration toward a horizontal position after the reciprocal pole holders have reached the rear end of the motor vehicle shelter to shelter the motor vehicle rear in the deployed position; and parallel tracks on which the reciprocal pole holders move between the front end and the rear end;

wherein the reciprocating pole holders and the rear pole holders are mounted on swing arms that are pivotally mounted at a front end of the tracks.

8. The motor vehicle shelter of claim 7 wherein the front pole holders are mounted on the tracks instead of on the swing arms.

9. The motor vehicle shelter of claim 8 wherein the swing arms are upright, relative to the tracks, when the motor vehicle shelter is in the stored position and are aligned with the tracks when the motor vehicle shelter is in the deployed position.

10. An erectable and collapsible shelter deployable over a movable object, the shelter comprising:

a motor;

a pair or rails, each rail including a movable elongate member, the movable elongate members being powered by the motor;

a canopy movable between opposite ends of the rails in response to motor driven operation of the movable elongate members;

a plurality of movable arch members extending between the pair of rails to support the canopy, the movable arch members being connected to the movable elongate members so that the arch members move along the rails in response to movement of the movable elongate members, the arch members being disconnectable from the movable elongate members for movement of the arch members to a storage position in which the canopy is collapsed; and wherein the movable elongate members comprise belts reciprocal along the rails; and wherein a portion of the poles are mounted on swing arms pivotal to each rail adjacent one end, the swing arms being rotatable away from the belts to disconnect a portion of the arch members from the belts so that the arch members and the canopy can be rotated into a storage position.

11. The erectable and collapsible shelter of claim 10 wherein the motor is connected to the belts by a drive shaft extending between the rails, rotation of the drive shaft imparting simultaneous linear movement to the both belts.

12. The erectable and collapsible shelter of claim 11 wherein the motor and the drive shaft are located in a housing adjacent one end of the rails.

13. The erectable and collapsible shelter of claim 12 wherein the swing arms are rotated by electrically driven linear actuators.

* * * * *